United States Patent [19]

Okawara

[11] 4,245,580

[45] Jan. 20, 1981

[54] DEVICE FOR COATING GRANULAR SOLIDS

[75] Inventor: Kahei Okawara, Shizuoka, Japan

[73] Assignee: Ohkawara Mfg. Co., Ltd., Haibara, Japan

[21] Appl. No.: 34,677

[22] Filed: Apr. 30, 1979

[30] Foreign Application Priority Data

Sep. 26, 1978 [JP] Japan ..... 53/118972

[51] Int. Cl.[3] ..... B05C 5/00

[52] U.S. Cl. ..... 118/19; 118/20; 118/24

[58] Field of Search ..... 118/19, 20, 24, 303; 366/45, 185; 34/133, 139

[56] References Cited

U.S. PATENT DOCUMENTS 2,652,805 9/1953 D'Angelo ..... 118/19

3,357,398 12/1967 Gross ..... 118/20 X

FOREIGN PATENT DOCUMENTS 53-43475 11/1978 Japan ..... 118/20

*Primary Examiner*—John P. McIntosh

*Attorney, Agent, or Firm*—Armstrong, Nikaido, Marmelstein & Kubovcik

[57] ABSTRACT

In a device for coating granular solids of the type having a double-cone rotary drum which is perforated so as to permit the flow of air or gas into and out of the rotary drum and which is tiltable about the axis at right angles of the axis of rotation of the rotary drum so that in the case of the discharge of product solids, the discharge opening of the rotary drum may be directed downwards, axially annular insulating covers are provided which ensure the effective thermal insulation of the rotary drum when the hot air or gas is blown thereinto. The present invention further provides means which are very effective in gas-tightly sealing the gas supply and exhaust passages defined in the duct around the rotary drum and the annular covers attached thereon so as to provide the air thermal insulation layers. In addition the present invention provides a mechanism which may suitably adjust the height of the rotary drum and more particularly the charging and discharging opening thereof so that the charging of process solids into the rotary drum and the discharge of product solids therefrom may be much facilitated.

2 Claims, 7 Drawing Figures

DEVICE FOR COATING GRANULAR SOLIDS

BACKGROUND OF THE INVENTION

1. Field of the Invention

The present invention relates to a device for coating granular solids such as tablets, catalyst-carrying particles and so on.

2. Brief Description of the Prior Art

Japanese Patent Publication No. 43 475/78 discloses a rotary drum type device for coating granular solids. In this device, a rotary drum comprises a cylindrical section with the wall perforated so as to permit the flow of air into and out of the rotary drum, and side walls contiguous with the cylindrical section. One side wall is formed with a charging and discharging opening while the other side wall is rigidly connected to a rotary or drive shaft which in turn is rotatably supported on a supporting frame or yoke and is drivingly connected to a prime mover through a suitable power transmission mechanism. An annular duct which is mounted around the cylindrical section of the rotary drum is divided into a lower space which serves as a gas supply passage and an upper space which serves as a gas exhaust passage. This air duct is provided with a pair of hollow tilting shafts which are diametrically opposed and radially outwardly extended and whose axes are at right angles of the axis of the rotary drum or the rotary shaft. These hollow tilting shafts are communicated with the gas supply and exhaust passages, respectively, and are rotatably supported on supporting stands. The gas supply passage is communicated through one tilting shaft with a blower disposed within one supporting stand while the gas exhaust passage is communicated through the other hollow tilting shaft with an exhaust fan or the like disposed in the other supporting stand. Therefore the air or suitable processing gas may continuously flow through the rotary drum during the coating operations. There is provided a tilting mechanism which is operatively connected to one of the tilting shafts so that the rotary drum may be tilted relative to the vertical about the axis of the hollow tilting shafts. That is, in the case of the coating operations, the axis of the rotary drum may be maintained horizontal so that the charging and discharging opening may be in the horizontal position, but in the case of the discharge of the product solids, the rotary drum is tilted so that the charging and discharging opening may be directed downwards and consequently the product solids may be completely, quickly and easily discharged out of the rotary drum.

However the rotary drum type coating device of the type described is not provided with a mechanism which may adjust the height of the rotary drum. It is desired to bring the rotary drum as closely to the floor as possible in the case of the inspection, maintenance and adjustments of the component parts in the rotary drum and of the charging of process solids. Furthermore it is also desired to adjust the height of the charging and discharging opening of the rotary drum, which is directed downwards in the case of the discharge as described above, depending upon the height of a product solid receiving vessel or the like so that the complete, quick and easy discharge may be ensured.

The rotary drum type coating device of the type described is further disadvantageous in that it is not provided with suitable thermal insulation means so that the heat of the hot air or the like forced into the rotary drum may be quickly dissipated to the surrounding air.

As a result, saving in thermal energy cannot be attained and the drying efficiency is low.

SUMMARY OF THE INVENTION

Accordingly, one of the objects of the present invention is to provide a device for coating granular solids provided with means which may attain the effective thermal insulation of the rotary drum when the hot air is blown into it so as to attain saving in thermal energy and to improve the drying efficiency.

Another object of the present invention is to provide a device for coating granular solids provided with means capable of attaining the effective gas-tight sealing of the gas supply and exhaust passages in the duct around the rotary drum and of the annular covers attached to the side walls of the rotary drum so as to provide the air thermal insulation layers.

A further object of the present invention is to provide a device for coating granular solids provided with a mechanism which may adjust the height of the rotary drum and more particularly the charging and discharging opening thereof so that the charging of process solids into the rotary drum as well as the discharge of product solids therefrom may be much further facilitated.

The present invention provides a device for coating granular solids comprising a rotary drum having a central cylindrical member made of gas permeable material, two side plates connected to the ends thereof and a rotary shaft extended from one side plate; two supporting stands for supporting said rotary drum; a driving device drivingly coupled to said rotary shaft for rotating said rotary shaft in a predetermined direction; a casing surrounding said cylindrical member of said rotary drum; a device which supplies a coating material and sprays the same so as to spray said coating material into the interior of said rotary drum; an opening formed through the other side plate; a supply passage and an exhaust passage air-tightly formed in the space between said rotary drum and said casing; a gas supply duct which extends from one side of said casing, is rotatably supported by one supporting stand and is communicated with said supply passage; a gas exhaust duct which extends from the other side of said casing is, supported for rotation by the other supporting stand and is communicated with said exhaust passage; rotary drum tilting means which is drivingly connected to either said gas supply duct or said gas exhaust duct so as to cause said rotary drum to tilt about said ducts; annular covers which are mounted on the outer sides of said side plates of said rotary drum, the interiors of said annular covers normally containing air; and sealing means which air-tightly seals said annular covers and said supply and exhaust passages and which includes a sealing member made of an elastic material and a holder retaining said sealing member, the free end of said sealing member being coated with an abrasion resisting material such as polytetrafluoroethylene.

According to the present invention, the rotary drum includes the annular covers which cover substantial portions of the frustoconical side walls of the rotary drum so as to define the air or water jacket-like spaces between them. Normally the air is confined within these spaces so as to thermally insulate the rotary drum, whereby saving in thermal energy may be attained and the drying efficiency may be remarkably improved.

Furthermore the present invention provides means which may attain very effective sealing of the gas supply and exhaust passages in the duct and of the annular covers.

In addition, the present invention provides a mechanism which may adjust the height of the rotary drum and more particularly of the charging and discharging opening thereof. Therefore the rotary drum may be brought to a position as closely to the floor as possible so that the inspection, maintenance and adjustments of the rotary drum may be facilitated and the charging of the process solids into the rotary drum may be also facilitated. Moreover depending upon the height of a product receiving vessel or the like, the height of the charging and discharging opening of the rotary drum may be suitably adjusted and directed downwards as described hereinafter so that the complete, quick and easy discharge may be ensured.

DESCRIPTION OF THE PREFERRED EMBODIMENTS

Figure 1:
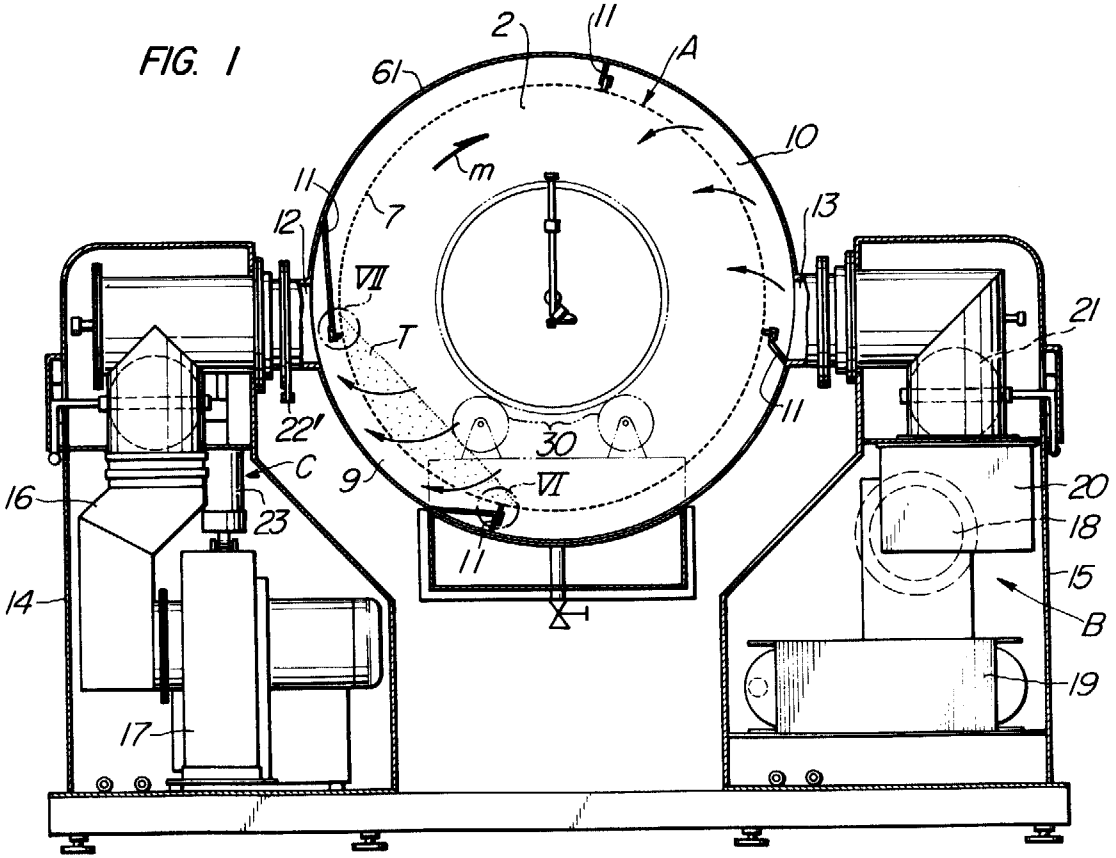
FIG. 1 is a front view in cross section of a preferred embodiment of the present invention.
Figure 2:
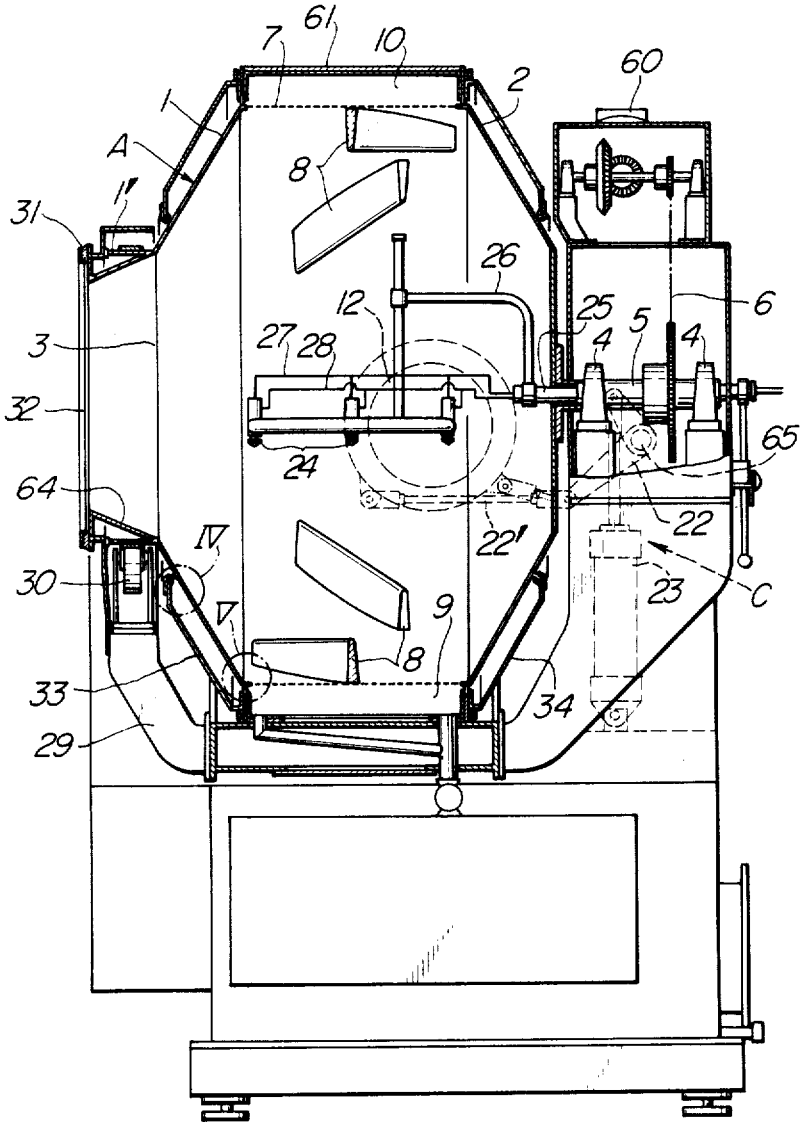
FIG. 2 is a side view in cross section thereof.

Referring to FIGS. 1 and 2, a device for coating granular solids has double cone rotary drum generally indicated by the reference character A and comprised of a cylindrical section 7 and frustoconical side walls 1 and 2 contiguous therewith. A reduced diameter cylindrical section 1' is extended from the small base of the side wall 1 coaxially and outwardly of the rotary drum A so as to define an opening 3 for the inspection, maintenance and adjustments of the component parts inside the rotary drum A and for the charging of process granular solids. The opening 3 is normally closed with a door or cover 31 formed with an inspection window 32. The opening 3 or the cylindrical section 1' is fitted with a frustoconical guide member 64 in such a way that the flange extended from the small base edge or rim abuts against the inspection window glass while the large base rim smoothly merges with the small base rim of the side wall 1.

The side wall 2 is securely connected to a rotary shaft 5 which is partly extended into the rotary drum A through a center hole formed through the side wall 2 and is rotatably supported by horizontally or axially spaced bearings 4. The rotary or drive shaft 5 is operatively connected to a prime mover 60 through a power transmission mechanism 6 so that the rotary drum A may be rotated in a predetermined direction.

The cylindrical section 7 is made of an air permeable material or more particularly perforated plates so that the air flows into or out of the rotary drum through the perforated cylindrical wall. A plurality of agitating blades 8 are mounted on the cylindrical wall within the cylindrical section 7 and are spaced apart from each other by a suitable distance.

An annular space is defined between the cylindrical section 7 of the rotary drum A and a cylindrical housing 61 surrounding the section 7 coaxially thereof. Within the annular space, two air ducts 9 and 10 are defined by the cylindrical section 7, cylindrical housing 61 and four partition members 11, as best shown in FIG. 1. The housing 61 has a pair of hollow tilting shafts 12 and 13 which are radially outwardly extended in diametrically opposed relationship with each other in such a way that the extension of their axes may be perpendicular to the axis of the rotary drum A. The hollow tilting shafts 12 and 13 are rotatably mounted on a pair of hollow supporting frames or stands 14 and 15 so that the rotary drum A may be tilted with respect to the vertical in unison with the housing 61 as will be described in more detail below. In addition, the hollow tilting shafts 12 and 13 serve as air duct sections in communication with the air ducts 9 and 10, respectively; that is, the tilting shaft 12 serves as an exhaust duct while the tilting shaft 13, as an air intake duct.

One of the supporting frames 14 and 15 houses a tilting mechanism C for tilting the rotary drum A, and an exhaust fan 17 communicated through a connecting duct section 16 with the hollow tilting shaft 12 which is the exhaust duct section. The other supporting frame 15 houses an air intake system or device generally indicated by the reference character B and comprised of an air intake port 18, a heat exchanger 19 for heating the air admitted through the intake port 18, a filter 20 for removing dust and the like entrained in the air discharged from the heat exchanger 19, a connecting duct section communicating the heat exchanger 19 with the tilting shaft 13 or the intake duct section and a damper 21 disposed within the connecting duct section between the filter 20 and the tilting shaft 13 so as to control the flow rate of the air flowing into the rotary drum A.

The tilting mechanism C which is housed within the supporting frame 14 for tilting the rotary drum A comprises a power cylinder, pneumatic or hydraulic, 23, a bell crank 22 which is provided with a pivot pin 65 to the supporting frame 14 and has its one end pivoted to to the piston rod of the power cylinder 23 and a connecting rod 22' one end of which is pivoted to the other end of the bell crank 22 and the other end of which is operatively connected to the tilting shaft 12. Therefore upon extension of the piston rod of the power cylinder 23 the tilting shaft 12 is rotated in one direction so that the housing 61 and hence the rotary drum A may be tilted about the axis of the tilting shafts 12 and 13. Upon retraction of the piston rod of the power cylinder 23, the rotary drum A is rotated in the other direction.

A nozzle assembly consisting of a plurality of nozzles 24 is suspended from a bracket 26 which in turn is mounted on a supporting pipe 25 fitted in the inner end of the rotary or drive shaft 5. Each of the nozzles 24 is communicated not only with a coating material source through a coating material feed pipe 27 but also a compressed air source through a compressed air pipe 28.

As best shown in FIG. 2, the rotary drum A including the housing 61 is supported by a supporting yoke 29. That is, the wall of the cylindrical section 1' is supported for rotation by a pair of supporting rolls 30 mounted at one arm of the supporting yoke 29. The rotary or drive shaft 5 of the rotary drum A is rotatably supported by the bearings 4 which in turn are mounted on the supporting yoke 29 at the other arm thereof. The prime mover 60 and the power transmission mechanism 6 are also mounted on the supporting yoke 29. Therefore when the power cylinder 23 is actuated so as to rotate the tilting shaft 12 in the manner described above, the devices mounted on the supporting yoke 29 are tilted in unison about the axis of the tilting shafts 12 and 13.

The inclined side walls 1 and 2 are covered with water-/and air-jacket type covers 33 and 34. During the coating operations the air is confined within the spaces between the side walls 1 and 2 and their covers 33 and 34 for heat insulation, but in the case of cleaning the interior of the rotary drum A, these spaces serve to receive the water flowing out of the space between the cylindrical section 7 of the rotary drum A and its housing 61 through communication holes described hereinafter.

Figure 4:
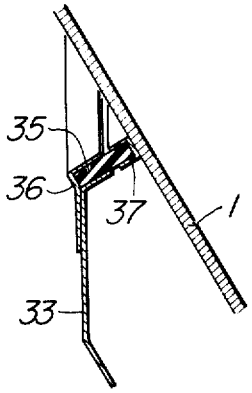
FIGS. 4, 5, 6 and 7 are enlarged views of parts indicated by IV and V in FIG. 2 and by VI and VII in FIG. 1, respectively.

In FIG. 4 is shown, on an enlarged scale, a portion encircled by a circle IV in FIG. 2. A sealing member 35 made of an elastic material such as silicon rubber is securely retained by a holder or retainer 36 which in turn is securely attached to the free end of the cover 33. The tip of the sealing member 35 is fitted with a protective cover or cap 37 made of an abrasion resisting material such as polytetrafluoroethylene and made into sealing contact with the outer surface of the side wall 1. A similar sealing arrangement is provided between the cover 34 and the side wall 2 (See FIG. 2).

Figure 5:
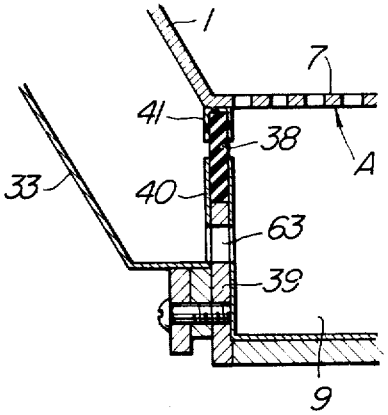

In FIG. 5 is shown, on an enlarged scale, a portion enclosed by the circle V in FIG. 2. A sealing member 38 is made of an elastic material such as silicon rubber and is securely retained by a holder or retainer 40 which in turn is mounted on a partition wall 39 disposed between the air duct 9 and the cover 33. The tip of the sealing member 38 is also fitted with a protective cap 41 made of an abrasion resisting material such as polytetrafluoroethylene and made into sealing contact with the outer wall surface of the cylindrical section 7 of the rotary drum A adjacent to the large base rim of the frustoconical side wall 1. The interior of the cover 33 and the air duct 9 are communicated with each other through communication holes 63 formed through the holder or retainer 40. A similar sealing arrangement is provided between the air duct 9 and the cover 34 (See FIG. 2).

Figure 6:
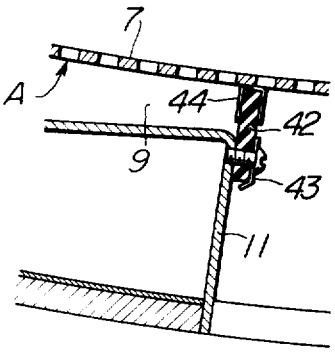

In FIG. 6 is shown, on an enlarged scale, a portion indicated by the circle VI in FIG. 1. A sealing member 42 made of an elastic material such as silicon rubber is securely attached with a retainer 43 and a screw to the partition member 11 at one end of the air duct 9. The tip of the sealing member 42 is fitted with a protective cap 44 made of an abrasion resisting material such as polytetrafluoroethylene and made into sealing contact with the outer surface of the cylindrical section 7.

Figure 7:
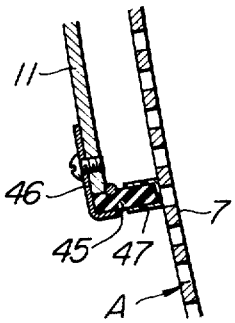

In FIG. 7 is shown, on an enlarged scale, a portion designated by the circle VII in FIG. 1. A sealing member 45 made of an elastic material such as silicon rubber is securely attached with a seal retainer 46 and screws to the partition member 11 at the other end of the air duct 9. The tip of the sealing member 45 is fitted with a protective cap 47 made of an abrasion resisting material such as polytetrafluoroethylene and made into sealing contact with the outer surface of the cylindrical section 7. The remaining partition members 11 (See FIG. 1) are also provided with the sealing means substantially similar in construction to those described above.

Figure 3:
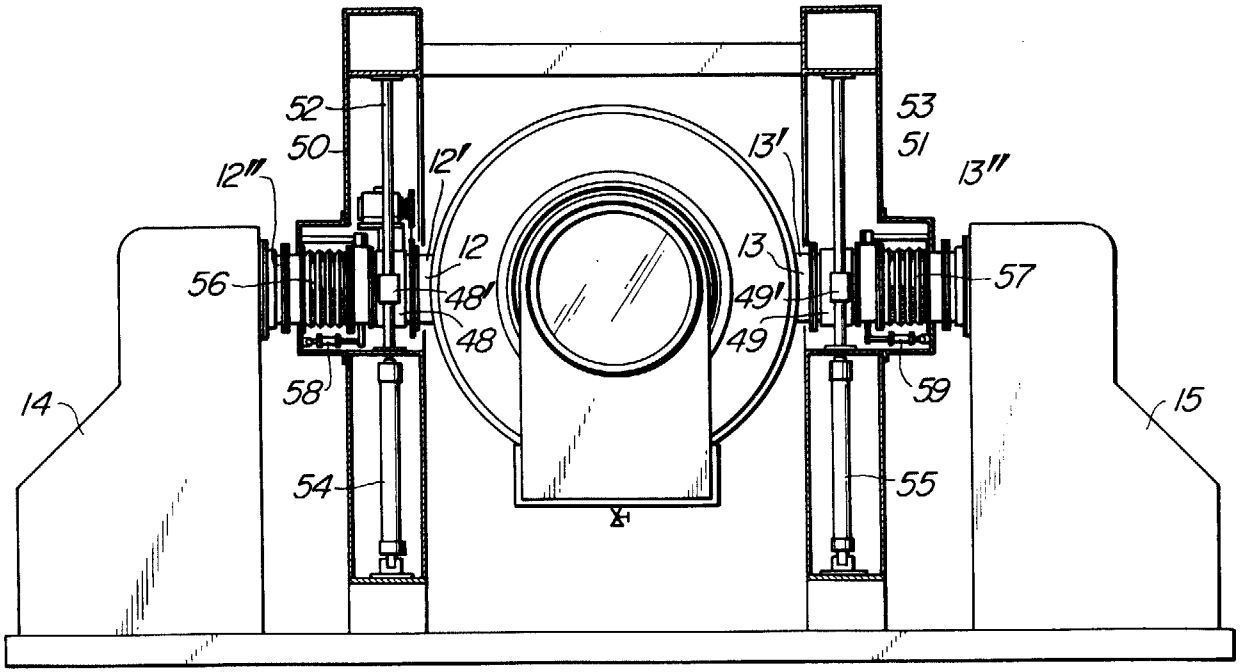
FIG. 3 is a front view in cross section of a variation of the device shown in FIG. 1 which is further provided with a mechanism for raising and lowering the rotary drum.

FIG. 3 is a variation of the device shown in FIG. 1. It is additionally provided with a mechanism for elevating the rotary drum A. In the figure, 48 and 49 are bearings of the hollow tilting shafts 12 and 13, i.e., bearings of the exhaust duct 12 and the air intake duct 13, which bearings are vertically movable so as to elevate the rotary drum A. Extensions 48' and 49' of these bearings are made into engagement with vertical guides 52 and 53 supported by frames 50 and 51, and an elevating device including cylinders 54 and 55 pushes up or lowers the bearings 48 and 49. 56 and 57 are clutches which engage the elevating parts 12' and 13' of the ducts 12 and 13 with the stationary parts 12'' and 13'' of the exhaust duct 12 and the intake duct 13 which are supported on the supporting frames 14 and 15 or disengage the elevating parts 12' and 13' from the stationary parts 12'' and 13'' and which are comprised of expandable members such as bellows. When they are expanded by operating members 58 and 59 such as cylinders, the connection between both parts of the pipes may be effected, but when they are contracted both parts of the pipes are separated from each other so that the vertical movement of the rotary drum A is not prevented.

Because the device, which is an embodiment of the present invention is constructed in the manner described above, after the opening 3 of the rotary drum A is held in such a way that its axis is substantially horizontal as shown in FIG. 2 and the materials such as tablets are charged, the rotary drum A is rotated in the direction m in FIG. 1. Then the materials are displaced to some extent to the direction in which the rotary drum A is rotated, and the tumbling bed T in which the materials are tumbled and mixed is formed in the interior while the air is blown into the air duct 10 and the air is exhausted or drafted through the exhaust duct 12 from the air duct 9 so that the air permeates through the materials in the tumbling bed T from the upper right to the lower left. Under these conditions, the coating agent and the compressed air are sprayed from the spray nozzles 24 in such a way that the coating agent may be uniformly sprayed over the surface of the tumbling bed T. Then while the materials are tumbled and mixed, their surfaces are coated with the coating agent. The air flows continuously from the upper right through the tumbling bed T so that the efficient drying of the coating agent applied to the surfaces of the materials may be attained. Because of the air flow described above, the coating agent sprayed through the spray nozzles 24 is collected at the tumbling bed T so that the adhesion of the coating agent to the interior surfaces of the rotary drum A may be nearly eliminated. As a result, the loss of the coating agent is less and the uniform coating may be attained within a short time.

After coating, the rotary drum A is tilted by the tilting mechanism C in such a way that the opening 3 is directed downwards. Consequently, the products in the rotary drum A can be immediately discharged through the opening 3 into a receptacle below.

The materials thrown into the opening 3 during the operation of the device roll down over the inclined interior surface of the guide member 64 into the tumbling bed T so that there is no fear that the products with incomplete coating result.

In addition, in this device the coating agent spray nozzles 24 are supported within the rotary drum A by means of the supporting pipe 25 fitted in the rotary shaft 5 and the pipes 27 and 28 to the nozzles are also extended through the interior of the rotary shaft 5 so that obstacles such as pipes, exhaust and intake ducts and so on do not exist in the opening 3 of the rotary drum A and consequently the adjustments and operations of the nozzles, the maintenance of the device and the charging of the materials may be quickly accomplished through the opening.

Furthermore in the case of the device shown in FIG. 3, the elevating parts 12' and 13' of the exhaust pipe 12 and the air intake pipe 13 which parts are connected to the rotary drum A are supported by the bearings 48 and 49. Therefore when the materials are charged into the rotary drum A, the clutches 56 and 57 which engage the elevating parts 12' and 13' of the exhaust pipe 12 and the intake pipe 13 with the stationary parts 12'' and 13'' thereof are released. Thereafter the bearings 48 and 49 are lowered by the cylinders 54 and 55 and the rotary drum A is lowered so that the opening 3 thereof may be held as low as possible. Then the charging of the materials into the rotary drum A is much facilitated. Therefore under these conditions the materials are charged and then the bearings 48 and 49 are pushed upwards by the cylinders 54 and 55 until the elevating parts 12' and 13' coincide with the stationary parts 12'' and 13''. Thereafter by means of the clutches 56 and 57, said both parts are connected to each other, and the rotary drum A is rotated while the hot air is supplied and the coating agent is sprayed. After coating, the clutches 56 and 57 are disengaged and the bearings 48 and 49 are pushed upwards by the cylinders 54 and 55 until the rotary drum A is elevated to a suitable position which is dependent upon the height of the product receptacle. Thereafter the rotary drum A is tilted downwards so that the discharge of the materials which have been coated may be quickly effected.

What is claimed is:

1. A device for coating granular solids comprising a rotary drum having a central cylindrical member made of gas permeable material, two side plates connected to the ends thereof and a rotary shaft extended from one side plate defining an axis of rotation; two supporting stands for supporting said rotary drum; a driving device drivingly coupled to said rotary shaft for rotating said rotary shaft in a predetermined direction about said axis; a casing surrounding said cylindrical member of said rotary drum; a device which supplies a coating material and sprays the same so as to spray said coating material into the interior of said rotary drum; an opening formed through the other side plate; a supply passage and an exhaust passage air-tightly formed in the space between said rotary drum and said casing; a gas supply duct which extends from one side of said casing, is rotatably supported by one supporting stand and is communicated with said supply passage; a gas exhaust duct which extends from the other side of said casing, is supported for rotation by the other supporting stand and is communicated with said exhaust passage; rotary drum tilting means which is drivingly connected to either said gas supply duct or said gas exhaust duct so as to cause said rotary drum to tilt about said ducts; annular insulating covers which are mounted over the outer sides of said side plates of said rotary drum, said covers being annular with respect to said axis, the interiors of said annular covers normally containing air and being open to said exhaust passage; and sealing means which air-tightly seals said interiors of said annular covers from said supply passage and outside air and which includes a sealing member made of an elastic material and a holder retaining said sealing member, the free end of said sealing member being coated with an abrasion resisting material such as polytetrafluoroethylene.

2. A device for coating granular solids as defined in claim 1 further comprising a device wherein an additional duct is provided and securely supported on each of said supporting stands in such a way that it may be engaged with or disengaged from said gas supply duct or said gas exhaust duct through a clutch and that when disengaged, said rotary drum may be elevated or lowered together with said gas supply duct and said gas exhaust duct.

* * * * *